US008596896B2

(12) United States Patent
Kimura

(10) Patent No.: US 8,596,896 B2
(45) Date of Patent: Dec. 3, 2013

(54) CLEANING TOOL

(75) Inventor: Eiki Kimura, Tokyo (JP)

(73) Assignee: Kao Corporation, Tokyo (JP)

( * ) Notice: Subject to any disclaimer, the term of this patent is extended or adjusted under 35 U.S.C. 154(b) by 392 days.

(21) Appl. No.: 12/812,645

(22) PCT Filed: Jan. 23, 2009

(86) PCT No.: PCT/JP2009/051524
§ 371 (c)(1),
(2), (4) Date: Jul. 13, 2010

(87) PCT Pub. No.: WO2009/096500
PCT Pub. Date: Aug. 6, 2009

(65) Prior Publication Data

US 2010/0316432 A1 Dec. 16, 2010

(30) Foreign Application Priority Data

Feb. 1, 2008 (JP) ..... 2008-022477
Apr. 14, 2008 (JP) ..... 2008-104470

(51) Int. Cl.
*A46B 11/00* (2006.01)

(52) U.S. Cl.
USPC ..... 401/140; 401/138; 15/115; 15/320; 15/116.1; 15/116.2

(58) Field of Classification Search
USPC ..... 401/140, 138, 282, 283, 198, 199; 15/115, 116.1, 116.2, 228, 229.6, 15/229.13, 320, 403
See application file for complete search history.

(56) References Cited

U.S. PATENT DOCUMENTS 1,761,499 A * 6/1930 Sommerfield ..... 401/198
1,795,249 A * 3/1931 Carter ..... 401/23
2,307,858 A 1/1943 Rufo (Continued)

FOREIGN PATENT DOCUMENTS

EP 1 169 962 1/2002
FR 1 273 242 10/1961

(Continued)

OTHER PUBLICATIONS

U.S. Appl. No. 29/367,622, filed Aug. 10, 2010, Tawara, et al.

(Continued)

*Primary Examiner* — Gregory Huson
*Assistant Examiner* — Jennifer C Chiang
(74) *Attorney, Agent, or Firm* — Oblon, Spivak, McClelland, Maier & Neustadt, L.L.P.

(57) ABSTRACT

A cleaning tool (10) includes a cleaning head (11) and a handle (12) and is to be used with a cleaning sheet attached to the cleaning head (11). The cleaning head (11) has a gradual-liquid-release mechanism (16) including a liquid reservoir (14) and a gradual-liquid-release portion (15) that, by the action of hydrostatic pressure from above, gradually releases a liquid agent supplied to the liquid reservoir (14) to a cleaning face (17*a*) provided by a cleaning cushion (17) of the cleaning head (11) while causing the liquid agent to pass through a multitude of fine flow paths. The gradual-liquid-release portion (15) is provided continuously across substantially the entire width in the length direction of the substantially rectangular cleaning head (11) as viewed along the short-side direction of the cleaning head (11), the portion (15) provided facing the cleaning face (17*a*) of the cleaning head (11).

18 Claims, 4 Drawing Sheets

(56) References Cited

U.S. PATENT DOCUMENTS

| | | | | |
|---|---|---|---|---|
| 3,080,590 | A | 3/1963 | Mullinix et al. | |
| 3,458,265 | A * | 7/1969 | Andrini | 401/139 |
| 3,797,706 | A * | 3/1974 | Mule | 222/187 |
| 3,932,043 | A | 1/1976 | Joffre | |
| 4,119,386 | A * | 10/1978 | Cushing | 401/138 |
| 4,778,298 | A * | 10/1988 | Shin et al. | 401/27 |
| 4,830,674 | A * | 5/1989 | Kaufman | 134/16 |
| 4,971,471 | A | 11/1990 | Sloan | |
| 5,050,530 | A * | 9/1991 | Studebaker et al. | 118/264 |
| 6,899,485 | B2 * | 5/2005 | Hall et al. | 401/140 |
| 7,491,005 | B2 * | 2/2009 | Blom | 401/137 |
| 8,240,063 | B2 * | 8/2012 | Grimes | 34/381 |
| 2003/0098370 | A1 | 5/2003 | Zhang | |
| 2005/0152737 | A1 | 7/2005 | Tien et al. | |
| 2005/0265769 | A1 | 12/2005 | Blom | |
| 2006/0280546 | A1 * | 12/2006 | Dyer | 401/139 |

FOREIGN PATENT DOCUMENTS

| | | |
|---|---|---|
| JP | 11-290790 | 10/1999 |
| JP | 2000-70205 | 3/2000 |
| JP | 2000-201877 | 7/2000 |
| JP | 2002-119453 | 4/2002 |
| JP | 2002-136461 | 5/2002 |
| JP | 2003-19079 | 1/2003 |
| JP | 2003-319900 | 11/2003 |
| JP | 2005-204950 | 8/2005 |
| JP | 2005-528941 | 9/2005 |

OTHER PUBLICATIONS

Office Action issued Nov. 9, 2011 in Chinese Application No. 200980102467.4 (With English Translation).

Japanese Notice of Rejection issued Mar. 27, 2012, in Japan Patent Application No. 2008-104470 (with English translation).

Office Action issued Jun. 14, 2011 in Japanese Patent Application No. 2006-356273 (with English translation).

* cited by examiner

CLEANING TOOL

FIELD OF THE INVENTION

The present invention relates to a cleaning tool having a cleaning head.

BACKGROUND OF THE INVENTION

Various types of cleaning tools have been proposed for efficiently cleaning and/or finishing a surface to be cleaned, such as a floor, by supplying a liquid agent, such as a liquid cleaning agent or wax, to a cleaning cushion of a tool's cleaning head to moisten the cleaning cushion or a cleaning sheet attached thereto (see, for example, JP-A-2000-70205, JP-A-2005-528941, and JP-A-2000-201877).

The cleaning tool disclosed in JP-A-2000-70205 has, on its cleaning head, a bottle containing a liquid agent in a hermetically-sealed state, and by applying pressure on the bottle, the liquid agent is supplied to an applicator pad (cleaning cushion) through a discharge valve to be applied onto a surface to be cleaned such as a floor. The cleaning tool disclosed in JP-A-2005-528941 has a cleaning fluid supply container on its cleaning head, and by applying pressure on the cleaning fluid supply container, a fluid agent is supplied from the cleaning fluid supply container to a cleaning sheet attached to the cleaning head to moisten the cleaning sheet. The cleaning tool disclosed in JP-A-2000-201877 has a cartridge containing a cleaning fluid attached onto the tool's box-like element (cleaning head), and pressure from a pump provided on the tool's handle causes the cleaning fluid to be supplied to the surface of the cleaning head through nozzles provided in the cartridge.

SUMMARY OF THE INVENTION

The present invention relates to a cleaning tool having a cleaning head. The cleaning head has a gradual-liquid-release mechanism including a liquid reservoir and a gradual-liquid-release portion that, by the action of pressure, gradually releases a liquid agent supplied to the liquid reservoir while causing the liquid agent to pass through a multitude of fine flow paths. The gradual-liquid-release portion is provided continuously across substantially the entire width of the cleaning head as viewed along at least one direction.

BRIEF DESCRIPTION OF THE DRAWINGS

FIG. 2(*b*) is a perspective of a lid member having the hollow elastic element, with the top opening of a tank being opened up.

FIG. 5(*b*) is a cross-sectional view taken along line A-A in FIG. 5(*a*) for illustrating a structure of a cartridge-type gradual-liquid-release mechanism.

FIG. 6(*b*) is a bottom view illustrating a structure of a cleaning head.

FIG. 8(*b*) is a schematic bottom view illustrating another embodiment for providing a gradual-liquid-release portion across substantially the entire width of a cleaning head.

FIG. 8(*c*) is a schematic bottom view illustrating another embodiment for providing a gradual-liquid-release portion across substantially the entire width of a cleaning head.

FIG. 8(*d*) is a schematic bottom view illustrating another embodiment for providing a gradual-liquid-release portion across substantially the entire width of a cleaning head.

FIG. 8(*e*) is a schematic bottom view illustrating another embodiment for providing a gradual-liquid-release portion across substantially the entire width of a cleaning head.

FIG. 8(*f*) is a schematic bottom view illustrating another embodiment for providing a gradual-liquid-release portion across substantially the entire width of a cleaning head.

DETAILED DESCRIPTION OF THE INVENTION

Figure 1:
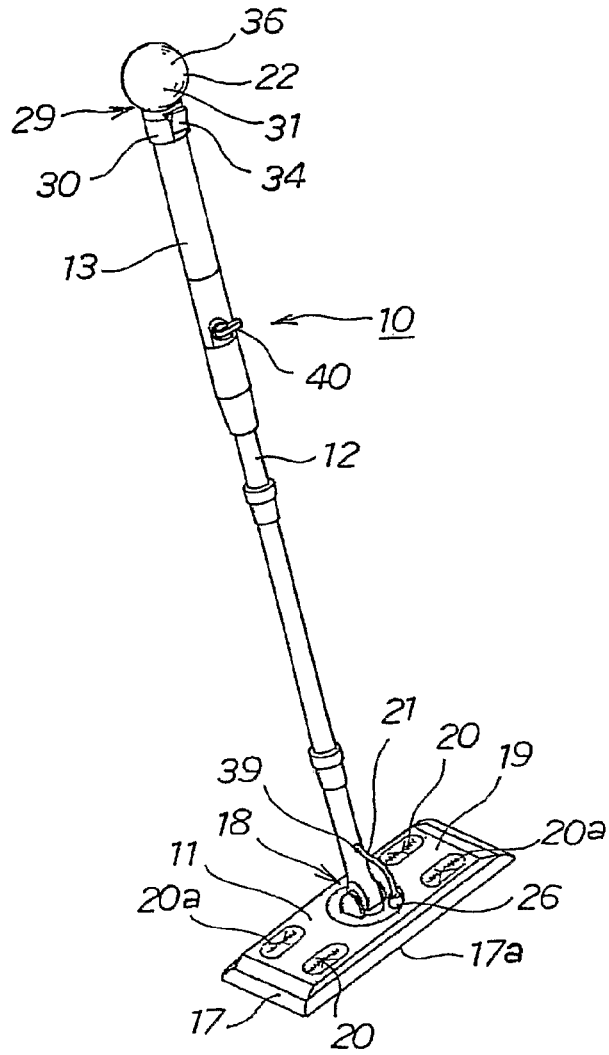
FIG. 1 is a perspective of a cleaning tool according to a preferred embodiment of the present invention.

In the foregoing conventional cleaning tools for cleaning and/or finishing floors and other surfaces to be cleaned with moistened cleaning cushions and/or cleaning sheets, a user directly exerts pressure on the bottle, the cleaning fluid supply container, or the cartridge provided on the cleaning head to discharge the liquid agent from a multitude of pore nozzles. Accordingly, a large amount of liquid agent will be applied to the surface to be cleaned through the pore nozzles immediately after exerting the pressure, for example. However, the amount of application of the liquid agent tends to become uneven due to, for example, the amount of liquid agent being applied gradually decreasing until the user applies pressure again. This makes it difficult to stably apply the liquid agent substantially evenly to the surface to be cleaned. Further, since the liquid agent is discharged through the pore nozzles, the liquid agent tends to be unevenly distributed and concentrates at sections of the cleaning sheet near the nozzles. This causes the liquid agent to be unevenly distributed on the surface to be cleaned, and leaving the liquid agent in this unevenly-distributed state may result in uneven liquid-agent application etc. and poor finish upon cleaning.

In cases where a worker recognizes such uneven distribution, he/she will repeatedly move the head sideways over a wide area to spread the liquid agent thinly and widely. This, however, impairs the cleaning efficiency. Further, in cases where a worker ends his/her cleaning without recognizing such uneven distribution of the liquid agent discharged onto the cleaning sheet, the finish upon cleaning may consequently become poor.

Incidentally, inventors of the present application have developed a cleaning tool having a tank provided above the cleaning head for containing a liquid agent, and a gradual-liquid-release portion provided on the cleaning head. The gradual-liquid-release portion has a function of gradually releasing a pressurized fluid while causing the fluid to pass through a multitude of fine flow paths. The tool utilizes the constantly-applied hydrostatic pressure due to the difference of the liquid agent contained in the tank to allow the liquid agent to be applied to a surface to be cleaned while being gradually released from the gradual-liquid-release portion stably and substantially evenly, without the need for applying pressure manually.

Such a cleaning tool, however, may pose difficulty in applying the liquid agent substantially evenly due to some reason where, for example, cleaning is resumed after once halting supply of the liquid agent from the tank to the gradual-liquid-release portion to temporarily quit the cleaning, or where cleaning is carried on for a long period of time. Accordingly, there is a demand for a novel technique that allows the tool to be easily restored to a state where the liquid agent is gradually released substantially evenly throughout the whole gradual-liquid-release portion. Further, depending on the type of cleaning, it may be desirable to temporarily release a large amount of liquid agent from the gradual-liquid-release portion.

The present invention relates to a cleaning tool that facilitates substantially-even application of a liquid agent to a surface to be cleaned and that can thus contribute to an increase in cleaning efficiency and improvement in finish upon cleaning.

The present invention also relates to a cleaning tool that can easily be restored to a state where the liquid agent is gradually released substantially evenly throughout the whole gradual-liquid-release portion even when the liquid-agent release by the gradual-liquid-release portion becomes uneven (unequal or unevenly distributed) and that can also temporarily release a large amount of liquid agent from the gradual-liquid-release portion when necessary.

The present invention relates to a cleaning tool having a cleaning head. The cleaning head has a gradual-liquid-release mechanism including a liquid reservoir and a gradual-liquid-release portion having a function of gradually releasing a liquid agent supplied to the liquid reservoir while causing the liquid agent to pass through a multitude of fine flow paths by the action of pressure, or releasing the liquid agent little by little, or moderating the outflow of the liquid agent by serving as a resistance to liquid outflow. The gradual-liquid-release portion is provided continuously across substantially the entire width of the cleaning head as viewed along at least one direction.

The term "pressure" as used herein not only includes pressure that is applied either directly or indirectly to the liquid agent using pressurizing means such as a pump, but also includes the so-called hydrostatic pressure produced by disposing the liquid agent above (i.e., at a point higher than) the release portion.

Further, the expression "the gradual-liquid-release portion is provided across substantially the entire width of the cleaning head as viewed along at least one direction" means that the gradual-liquid-release portion is continuously provided across substantially the entire width of the cleaning head in the width direction thereof except for its ends when viewing the cleaning head preferably along a direction in which the cleaning head is primarily moved while performing the cleaning. It is only necessary that the gradual-liquid-release portion be provided continuously in the width direction as viewed along the "at least one direction", and the gradual-liquid-release portion may be in a discontinuous state when viewing the head along another direction. Furthermore, it is preferable that the gradual-liquid-release portion is provided continuously across substantially the entire width of the cleaning head in the width direction thereof also when viewed, for example, along a direction perpendicular to the above-mentioned "at least one direction". For example, in cases where the bottom surface of the cleaning head, which serves as the cleaning face thereof, has a substantially rectangular shape, it is preferable that, in addition to continuously providing the gradual-liquid-release portion across substantially the entire width in the long-side direction when viewing the head along the short-side direction, the gradual-liquid-release portion is provided continuously across substantially the entire width in the short-side direction when viewing the head along the long-side direction.

A cleaning tool 10 according to a preferred embodiment of the present invention shown in FIG. 1 is used for cleaning and/or finishing surfaces to be cleaned such as floors, preferably with a disposable cleaning sheet (not shown) attached detachably and replaceably to a cleaning head (cleaning main body) 11 and moistened by a liquid agent such as a liquid cleaning agent or wax. The cleaning tool 10 of the present embodiment also has a tank 13 for containing the liquid agent positioned above the cleaning head 11 and in an upper portion of a handle 12. Supplying the liquid agent from the tank 13 via a liquid-supply pipe 21 to a gradual-liquid-release mechanism 16 (see FIGS. 3 and 4) provided in the cleaning head 11 allows cleaning and/or finishing work to be performed with the liquid agent being released from the gradual-liquid-release mechanism 16 by utilizing hydrostatic pressure. The cleaning tool 10 of the present embodiment also has a function of being easily restored to a state where the liquid agent is gradually released substantially evenly throughout the whole gradual-liquid-release portion 15 of the gradual-liquid-release mechanism 16 even when, for example, the liquid-agent release by the gradual-liquid-release portion 15 becomes uneven (unequal or unevenly distributed).

Figure 4:
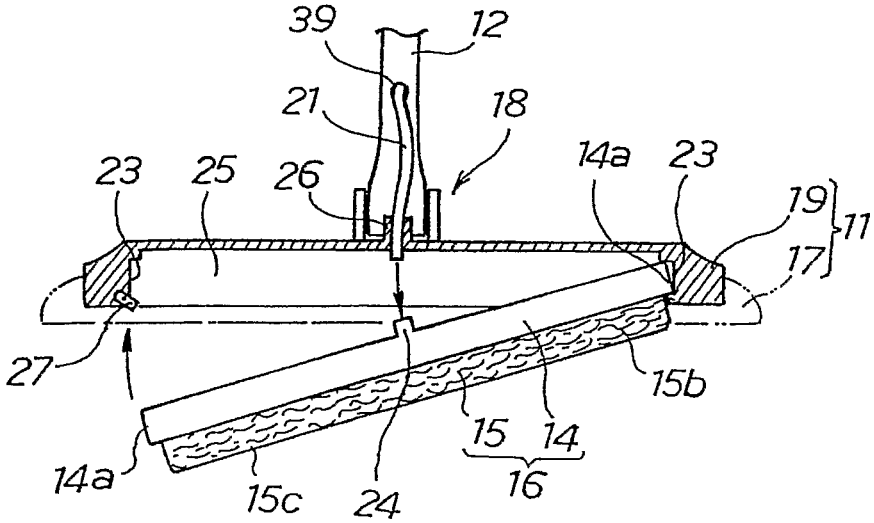
FIG. 4 is a cross-sectional view illustrating how a cartridge-type gradual-liquid-release mechanism is mounted onto a cleaning head.
Figure 6:
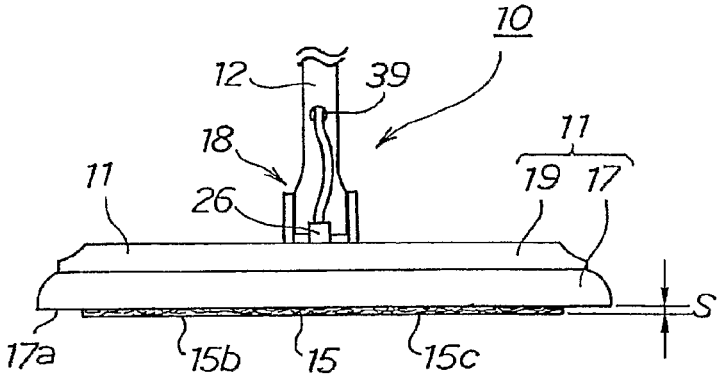
FIG. 6(*a*) is a front view illustrating a structure of a cleaning head.
Figure 6:
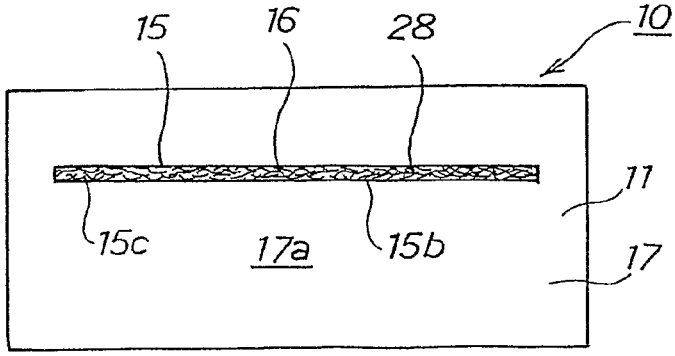

Further, as shown in FIG. 4, FIG. 6(*a*), and FIG. 6(*b*), the gradual-liquid-release portion 15 of the present embodiment is provided continuously across substantially the entire width in the length direction of the cleaning head 11, and thus has a function of facilitating substantially-even application of the liquid agent to the surface to be cleaned.

More specifically, the cleaning tool 10 of the present embodiment includes a cleaning head 11 to which a cleaning sheet (not shown) is preferably attached upon use, and a handle 12. As shown in FIG. 3 to FIG. 6(*a*) and FIG. 6(*b*), the cleaning head 11 has a gradual-liquid-release mechanism 16 (see FIG. 5) including a liquid reservoir 14 and a gradual-liquid-release portion 15 that, by the action of hydrostatic pressure exerted from above, gradually releases the liquid agent supplied to the liquid reservoir 14 to the bottom surface (cleaning face) 17*a* provided by the cleaning cushion 17 of the cleaning head 11 while causing the liquid agent to pass through a multitude of fine flow paths. The gradual-liquid-release portion 15 is provided continuously across substantially the entire width of the cleaning head 11 as viewed along at least one direction (along the transverse direction X in this embodiment) in such a manner as to face the bottom surface 17*a*, which serves as the cleaning face of the cleaning head 11. Note here that the gradual-liquid-release portion 15 is a member or component that has a function of gradually releasing the liquid agent supplied to the liquid reservoir 14 while causing the liquid agent to pass through a multitude of fine flow paths by the action of hydrostatic pressure, or releasing the liquid agent little by little, or moderating the outflow of the liquid agent by serving as a resistance to liquid outflow.

Further, the handle 12 of this embodiment has a tank 13 that is in communication with the liquid reservoir 14 via a liquid-supply pipe 21. The tank 13 has pressurizing means 22 for exerting pressure on a hydrostatic surface of the liquid agent contained in the tank. The liquid agent is supplied from the tank 13 through the gradual-liquid-release portion 15 to a cleaning sheet that covers the bottom surface 17*a* of the cleaning head 11, which serves as the cleaning face.

Figure 2:
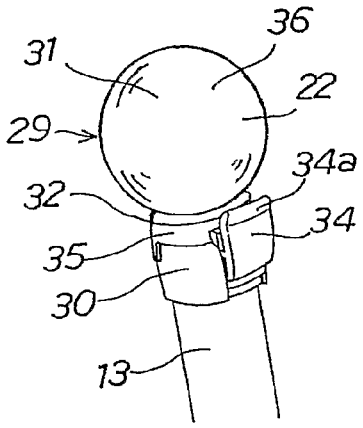
FIG. 2(*a*) is a perspective of a lid member having a hollow elastic element, with the lid member closing off a top opening of a tank.
Figure 2:
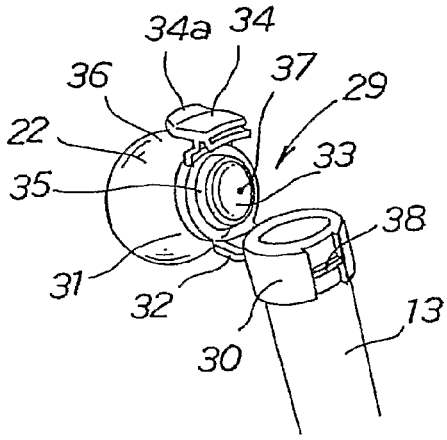

Furthermore, the pressurizing means 22 of this embodiment has a hollow interior that is in communication with the tank 13, and includes a check valve (not shown) having a function of allowing an inflow of air from ambient air while blocking an outflow of air to ambient air, and a hollow elastic element (see FIGS. 2(*a*) and 2(*b*)), and pressure is exerted on the hydrostatic surface of the liquid agent by compressing and deforming the hollow elastic element 22.

The cleaning head 11 and the handle 12 of this embodiment are connected by a known universal joint 18. Accordingly, the handle 12 can not only alter its position with respect to the cleaning head 11 to the front and rear within a vertical plane, but can also alter its position in all four directions—i.e., to the front, rear, left, and right. Moreover, the handle can swivel in any direction 360° wide, and the angle of the cleaning head 11 with respect to the horizontal can also be adjusted.

Figure 3:
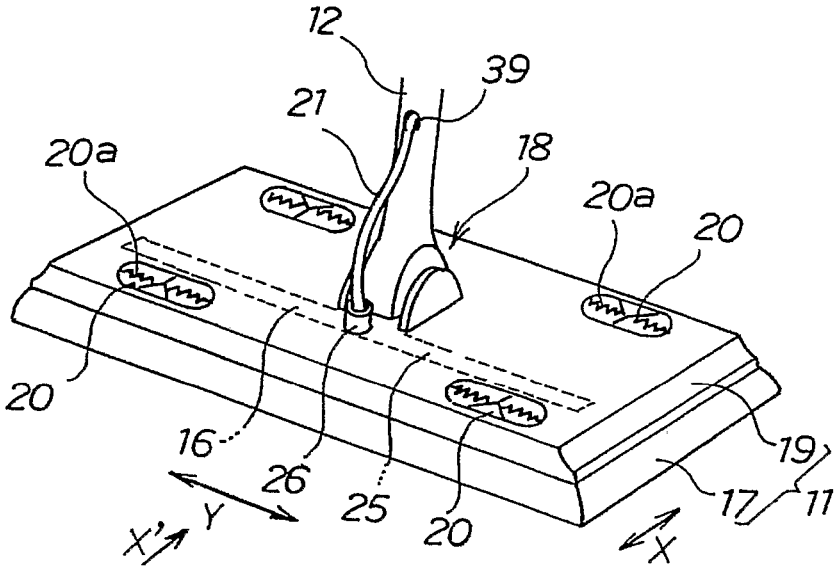
FIG. 3 is a perspective illustrating a structure of a cleaning head.

As shown in FIG. 3, the cleaning head 11 has a head body 19 made of synthetic resin formed into a substantially-rectangular, planar shape, and a cleaning cushion 17 mounted to the bottom surface of the head body 19, the bottom surface 17*a* of the cushion 17 constituting an elastic surface having a flat, substantially-rectangular, planar shape. The handle 12 is connected via the universal joint 18 to the head body 19 in the central portion on the top surface thereof. Receiving a pressing force from the handle 12 upon cleaning, the bottom surface 17*a* of the cleaning cushion 17 is placed in contact with the surface to be cleaned in an appropriately pressed state, with a cleaning sheet disposed between the bottom surface 17*a* and the surface to be cleaned.

The top surface of the head body 19 also has sheet retainers 20 respectively provided at four points in the peripheral regions of the body's top surface. Each sheet retainer 20 is of the known type that is made of a flexible elastic material and has a zigzag slit 20*a*. A cleaning sheet (not shown) can easily be attached to the cleaning head 11 detachably and replaceably by wrapping the cleaning sheet around the cleaning head 11 so as to cover the lower-side cleaning cushion 17 and then pressing the corners of the cleaning sheet respectively through the slits 20*a* and into the sheet retainers 20.

The top surface of the head body 19 also has an upwardly-projecting pipe-insertion sleeve 26 adjacent to the universal joint 18 and in a position corresponding to the central portion of a fitting recess 25, which is described further below. The lower end of the liquid-supply pipe 21 is inserted through the pipe-insertion sleeve 26 and is attached to a pipe-attaching portion 24 of the gradual-liquid-release mechanism 16, which is described further below.

Figure 5:
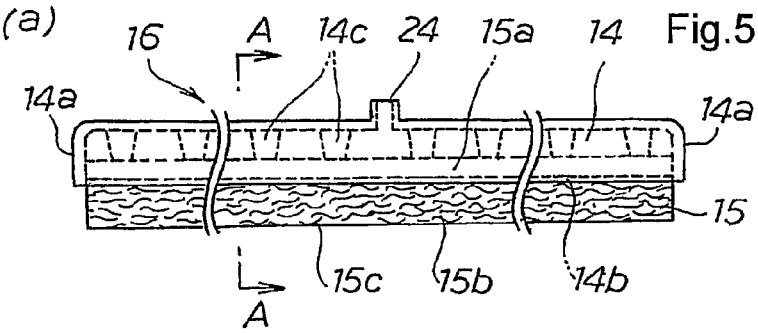
FIG. 5(*a*) is a partially-cutaway side view illustrating a structure of a cartridge-type gradual-liquid-release mechanism.
Figure 5:
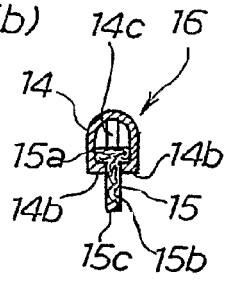

As shown in FIG. 4, the gradual-liquid-release mechanism 16 including the liquid reservoir 14 and the gradual-liquid-release portion 15 is disposed inside the head body 19. In this embodiment, the gradual-liquid-release mechanism 16 is a detachable-and-replaceable cartridge-type component. As shown in FIGS. 5(*a*) and 5(*b*), the gradual-liquid-release mechanism 16 has the liquid reservoir 14 and the gradual-liquid-release portion 15. The liquid reservoir 14 is a tubular tank portion made of synthetic resin having a substantially inverted-U-shaped cross section. Both ends of the liquid reservoir 14 are closed off by respective latching lids 14*a*, and the lengthwise brims of the bottom-side opening are bent inwardly to form respective engagement ribs 14*b*. The gradual-liquid-release portion 15 has a substantially T-shaped cross section and is made, for example, of a porous material such as sintered resin, felt, open-celled sponge, pulp, nonwoven fabric, and rubber. As is clear from FIG. 5(*a*), the liquid reservoir 14 has substantially the same length and width as the gradual-liquid-release portion 15 and is provided continuously across substantially the entire width of the cleaning head 11, like the gradual-liquid-release portion 15. The liquid reservoir 14 exists across the entire length of the gradual-liquid-release portion 15 on the rear side thereof (i.e., on the side opposite from the bottom surface), and as described below, the liquid agent supplied to the liquid reservoir 14 is supplied efficiently to the whole gradual-liquid-release portion 15 from the liquid reservoir 14.

The gradual-liquid-release portion 15 of the gradual-liquid-release mechanism 16 has a function of gradually releasing the liquid agent—that is, a function of reducing the liquid-agent passage speed and thereby oozing and discharging the liquid agent substantially evenly from the entire portion 15 by utilizing, for example, surface tension by the multitude of fine flow paths formed in the porous material upon causing the liquid agent, which has been supplied from the tank 13 to the liquid reservoir 14, to pass through the portion 15 by the action of hydrostatic pressure exerted from above. To allow such a function to be achieved effectively, it is preferable that the amount of liquid agent released is 0.01 to 0.5 g/sec, and more preferably 0.02 to 0.4 g/sec, and even more preferably 0.04 to 0.3 g/sec. The liquid-agent release amount can be adjusted by appropriately choosing/setting various parameters including properties of the liquid agent such as interfacial tension with the porous material and viscosity, and/or conditions of the porous material such as pore diameter and porosity. The release amount necessary for wet cleaning can appropriately be adjusted also by appropriately choosing/setting the permeability of the liquid agent through the porous material, and/or by appropriately optimizing the hydrostatic pressure of the liquid agent or the area through which the liquid agent is released. In cases where the porous material is selected with reference to air-permeability, which serves as an index indicating how easily air can pass through the porous material, it is preferable that the material used has an air-permeability of 0.5 to 200 μm/(Pa·sec), and more preferably 1.0 to 100 μm/(Pa·sec), and even more preferably 1.0 to 50 μm/(Pa·sec).

Further, it is preferable that the porous material constituting the gradual-liquid-release portion 15 has, for example, a pore diameter range of 3 to 50 μm (peak value of the pores) and a porosity of 5% to 60%.

The values of the pore diameter range are obtained through actual measurement according to the bubble point method or mercury intrusion porosimetry.

Actual measurement according to the bubble point method can be performed using an "Automated Perm Porometer" manufactured by Porous Materials, Inc. (PMI) (general agency in Japan: Seika Corporation; automated measuring instrument for pore size distribution of porous material). Galwick or Silwick available from the above-mentioned company can be used as the test liquid. The surface tension of Galwick and Silwick is 15.6 dyn/cm and 19.1 dyn/cm, respectively, and the surface tension of these test liquids hardly changes in temperatures equal to or below 100° C. Therefore, in this embodiment, measurement is carried out at a temperature of approximately 20° C.

Actual measurement according to mercury intrusion porosimetry can be performed using an "AutoPore IV 9520" manufactured by Micromeritics Instrument Corporation (sales agent: Shimadzu Corporation). In this embodiment, the surface tension of mercury is 485 dyn/cm, and measurement is carried out at a temperature of approximately 20° C.

The interfacial tension of the liquid agent is preferably 30 to 70 N/m.

Further, in addition to flow-rate adjustment achieved by the above-mentioned porous material for controlling the liquid-agent release amount (i.e., flow-rate adjustment achieved by the porous material's gradual-release function in which the liquid agent is gradually released while being passed through a multitude of fine flow paths, or in which the liquid agent is released little by little, or in which the outflow of the liquid agent is moderated due to the porous material serving as a resistance to liquid outflow), the present embodiment may adjust the release amount of the liquid agent by disposing a flow-rate adjustment mechanism (such as a throttle valve for controlling the flow rate by varying the flow-path area) upstream of the gradual-liquid-release portion 15, for example, at the outlet of the tank 13 or in an open/close valve of the liquid-supply pipe 21 that is opened and closed through an open/close lever 40 (described below) and thereby controlling the flow rate of the liquid agent.

Disposing a flow-rate adjustment mechanism upstream of the gradual-liquid-release portion 15 provides the gradual-liquid-release mechanism 16—which consists of the gradual-liquid-release portion 15 made of porous material and the liquid reservoir 14 functioning as a buffer—not only with the flow-rate adjustment function, but also with a function of evenly distributing the liquid agent primarily across the release surface of the gradual-liquid-release portion 15 (i.e., the lower end surface 15*c* of the leg 15*b* of the gradual-liquid-release portion 15). Further, the liquid-agent release amount can be controlled primarily by the flow-rate adjustment mechanism disposed upstream of the gradual-liquid-release portion 15. Thus, the liquid-agent release amount can be adjusted even more easily, particularly in cases where the release amount is relatively large or where the pore diameter or porosity of the gradual-liquid-release portion 15 is large.

The gradual-liquid-release portion 15 is integrally mounted on the liquid reservoir 14 in a state where the top portion 15*a* of the substantially T-shaped cross section is supported by the engagement ribs 14*b* and disposed inside the liquid reservoir 14 and where the leg 15*b* of the substantially T-shaped cross section protrudes downward from the slit-like opening between the engagement ribs 14*b* on both sides. Accordingly, the cartridge-type gradual-liquid-release mechanism 16 is formed having a strip-plate-like shape as viewed from the side.

The liquid reservoir 14 of this embodiment has a capacity of around 0.5 to 2 cc, for example, and has a pipe-attaching portion 24 projecting upwardly from its central portion. The lower end of the liquid-supply pipe 21 is detachably attached to the pipe-attaching portion 24 in a liquid-tight state. The liquid agent, which is supplied locally from the tank 13 to the gradual-liquid-release mechanism 16 through the liquid-supply pipe 21 and the pipe-attaching portion 24, is stored in the liquid reservoir 14 so that the liquid agent is dispersed throughout the entire storage region of the liquid reservoir 14. Accordingly, the liquid reservoir 14 functions as a so-called buffer, and allows the hydrostatic pressure to be exerted evenly from above across the entire top portion 15*a* of the gradual-liquid-release portion 15.

Further, a plurality of support ribs 14*c* are disposed inside the liquid reservoir 14 projecting downwardly from the inner surface of the top end of the reservoir and being spaced-away from one another in the axial direction of the liquid reservoir 14. The tip end of each support rib 14*c* is placed in contact with the upper surface of the top portion 15*a* of the gradual-liquid-release portion 15, and in this way, the support ribs 14*c* function as means for retaining the position of the gradual-liquid-release portion, which prevents the gradual-liquid-release portion 15 from moving upward and being excessively shoved into the liquid reservoir 14 due to the reaction force applied from the surface to be cleaned caused by the pressing force exerted on the cleaning head 11 upon cleaning. Note that, in place of the support ribs 14*c*, a step extending in the axial direction of the liquid reservoir 14 may be provided as the means for retaining the position of the gradual-liquid-release portion.

In this embodiment, the gradual-liquid-release mechanism 16 consisting of the liquid reservoir 14 and the gradual-liquid-release portion 15 is attached detachably and replaceably inside the head body 19, as shown in FIG. 4. More specifically, in this embodiment, a fitting recess 25 that opens toward the bottom surface of the head body 19 is provided inside the head body 19 substantially parallel to the length direction Y of the cleaning head 11 between, for example, the universal joint 18 and a pair of sheet retainers 20 disposed along one of the long sides of the head body 19 (see FIG. 3). For example, the lower end of the liquid-supply pipe 21 is attached to the pipe-attaching portion 24, and in this state, the cartridge-type gradual-liquid-release mechanism 16 is inserted to be fitted into the fitting recess 25 from the bottom of the fitting recess with its liquid reservoir 14 located upward. Then, for example, a portion of each of the latching lids 14*a*, which are provided on both ends of the liquid reservoir 14, is fitted into a respective one of latching recesses 23 that are provided in both ends of the fitting recess 25, and in this state, a latching projection 27 that is made retractable by a spring or other bias means is latched onto an end of one of the latching lids 14*a*. In this way, the gradual-liquid-release mechanism 16 can easily be attached into the head body 19.

As shown in FIGS. 6(*a*) and 6(*b*), the cleaning cushion 17 is mounted to the head body 19 covering the bottom surface thereof. A slit 28 is opened in the cleaning cushion 17, the slit 28 being formed in a position corresponding to the fitting recess 25 of the head body 19 and having almost the same width as that of the gradual-liquid-release mechanism 16. The gradual-liquid-release mechanism 16 is inserted into the slit 28, for example, from the side of the bottom surface 17*a* provided by the cleaning cushion 17 of the cleaning head 11. Accordingly, a lower end surface 15*c* of the leg 15*b* of the gradual-liquid-release portion 15 of the gradual-liquid-release mechanism 16 faces the bottom surface 17*a*, which serves as the cleaning face of the cleaning head 11, and is provided flush or substantially flush with the bottom surface 17*a* in a band-like shape. Further, the lower end surface 15*c* of the leg 15*b* of the gradual-liquid-release portion 15 is arranged parallel to the long side of the substantially-rectangular planar cleaning head 11 like a continuous straight line. A pressing force exerted on the cleaning head 11 upon cleaning will make the lower end surface 15*c* of the leg 15*b* of the gradual-liquid-release portion 15, together with the bottom surface 17*a* of the cleaning cushion 17, in contact with the surface to be cleaned, with a cleaning sheet disposed between the surface to be cleaned and the surfaces 17*a* and 15*c*.

In this embodiment, the width of the lower end surface 15*c* of the gradual-liquid-release portion 15 facing the cleaning face 17*a* of the cleaning head 11 is set to a length around one tenth of the length of the short side of the substantially-rectangular planar cleaning head 11. The width, however, can appropriately be determined depending on, for example, the amount of distribution of the liquid agent and/or the designed movement speed of the cleaning head 11 upon cleaning. It is preferable that the length of the gradual-liquid-release portion 15 be as close to the length of the long side of the cleaning head 11 as possible in terms of reducing the necessity of moving the head sideways during application of the agent; in this embodiment, the length of the portion 15 is set approximately 30 mm shorter than the long side because of restrictions imposed by the attach-detach mechanism, for example.

Further, the lower end surface 15*c* of the gradual-liquid-release portion 15 projects downward from the bottom surface 17*a* of the cushion 17 by a slight projection height S from the bottom surface 17*a* of the cushion 17 in a non-loaded state, the projection height ranging, for example, from over 0 mm to under 2 mm. Projecting the lower end 15*c* of the gradual-liquid-release portion 15 downward from the cleaning face 17*a* of the cushion 17 by a slight projection height allows the amount of liquid agent gradually released from the gradual-liquid-release portion 15 to be adjusted through the pressing force exerted on the cleaning head 11. Further, the cleaning cushion 17 surrounding the lower end 15*c* of the gradual-liquid-release portion 15 prevents the gradual-liquid-release portion 15 from flattening excessively even when a pressing force is exerted on the cleaning head 11, thereby allowing gradual release of a suitable amount of liquid agent.

Figure 7:
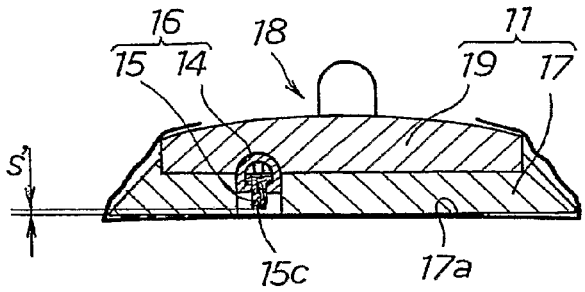
FIG. 7 is a schematic cross-sectional view illustrating a state in which the lower end surface of a gradual-liquid-release portion is arranged so as not to project from the bottom surface of a cleaning head.

On the other hand, as shown in FIG. 7, the lower end surface 15*c* of the gradual-liquid-release portion 15 does not have to project from the cleaning face 17*a* of the cushion 17 in the non-loaded state, but may instead be provided inward of the cleaning face 17*a* of the cushion 17 by a depth s' not exceeding 2 mm, for example. Even in cases where the lower end surface 15*c* of the gradual-liquid-release portion 15 does not project from the cleaning face 17*a* of the cushion 17, the liquid agent will move over to the cleaning sheet covering the bottom surface of the cleaning head 11 due to surface tension, etc. and spread across the cleaning sheet before it discharges and drips down from the gradual-liquid-release portion 15. Further, pressing and deforming the cushion 17 with the pressing force on the cleaning head 11 will bring the lower end surface 15*c* of the gradual-liquid-release portion 15 into contact with the surface to be cleaned via the cleaning sheet.

It is preferable to provide the lower end surface 15*c* of the gradual-liquid-release portion 15 inward of the cleaning face 17*a* in cases where the cleaning head 11 is made of an elastic component and the gradual-liquid-release portion 15 is made of a substantially non-elastic component, such as sintered metal, or a component less prone to elastic deformation than the cleaning head 11.

As shown in FIG. 1, the handle 12 connected to the cleaning head 11 via the universal joint 18 is a tubular component made, for example, of synthetic resin, and is about 50 to 120 cm long, for example, so that the cleaning tool 10 can suitably be used for carrying out cleaning while standing. A cylindrical tank 13 constituting a portion of a grip is provided on the upper portion of the handle 12. Further, the liquid-supply pipe 21, which provides communication between the tank 13 and the above-described liquid reservoir 14 of the gradual-liquid-release mechanism 16 provided in the cleaning head 11, is disposed inside the hollow interior of the handle 12. Note that the handle 12 itself may be used as a liquid-supply conduit by providing an appropriate sealing thereon.

The tank 13 is formed into a cylinder preferably using a transparent synthetic resin, and is integrally attached to the upper portion of the handle 12. The tank 13 has a capacity of about 20 to 100 cc, for example. As shown in FIGS. 2(*a*) and 2(*b*), a lid member 29 integrally provided with the hollow elastic element 22 as the pressurizing means is attached to the tank so as to openably/closably cover a top opening of the tank. Opening and closing the lid member 29 allows a liquid agent, such as a liquid cleaning agent or wax, to be refilled as appropriate.

The lid member 29 is made of an elastic rubber material, and includes a fixing sleeve 30 and a lid body 31 pivotally hinged to the fixing sleeve 30. The fixing sleeve 30 is a skirt-like component whose inner diameter is equal to or slightly smaller than the outer diameter of the tank 13. By elastically deforming the sleeve 30 and mounting it onto the top end of the tank 13 along the outer circumferential surface thereof, the sleeve 30 is fixed in a gas-tight state on the top end of the tank.

By pivoting about a hinge 32 with respect to the fixing sleeve 30, the lid body 31 can easily be switched between a closed-off state in which a fitting projection 33 formed on a base 35 of the lid body is fitted into an upper-surface opening of the fixing sleeve 30 in a gas-tight manner (see FIG. 2(*a*)) and an open state in which the base 35 is opened to open up the upper-surface opening of the fixing sleeve 30 (see FIG. 2(*b*)). The lid body 31 also has an engagement claw 34. By engaging and fixing the engagement claw 34 to an engagement projection 38 provided on the fixing sleeve 30 through elastic deformation of the claw 34, it is possible to firmly retain the hermetically-closed state of the top opening of the tank 13 (the upper-surface opening of the fixing sleeve 30) by the lid body 31. Further, the engaged state between the claw and the engagement projection 38 may be released by pressing an open operation part 34*a* on the engagement claw 34, which allows the top opening of the tank 13 to be opened easily.

In this embodiment, the lid body 31 serves as a component that constitutes the hollow elastic element 22 serving as the pressurizing means. The lid body 31 includes a disk-shaped base 35 and a bulb portion 36 formed integrally on the upper-surface side of the base 35 bulging out therefrom in a spherical shape. The base 35 is pivotally connected via the hinge 32 to the fixing sleeve 30. The above-described fitting projection 33 projects downward from the lower-surface side of the base 35. The base 35 has a known check valve (not shown) having a function of allowing an inflow of air from ambient air into the hollow elastic element 22 while blocking an outflow of air from inside the hollow elastic element 22 to ambient air. A vent 37 is opened through the center of the base 35 for providing communication between the hollow interior of the hollow elastic element 22 and the tank 13, and a known check valve (not shown) is provided in the vent 37 for allowing air to flow from the hollow elastic element 22 to the tank 13 while preventing air and/or liquid from flowing back from the tank 13 to the hollow elastic element 22.

Having such a configuration, the hollow elastic element 22 provided by the lid body 31 has a function of exerting pressure on the hydrostatic surface of the liquid agent contained in the tank 13 by, for example, pinching and pressing of the bulb portion 36 to compress and deform the same to thereby force the air therein toward the tank 13 through the vent 37. The bulb portion 36 being elastic, releasing the pressure on the bulb portion 36 will make the bulb portion 36 be restored to its original shape while taking in air through the check valve.

The liquid-supply pipe 21 that provides communication between the tank 13 and the gradual-liquid-release mechanism 16 of the cleaning head 11 may, for example, consist of a flexible synthetic resin tubular material. The liquid-supply pipe 21 has its upper end connected to the tank 13 inside the handle 12, is disposed inside and extends downward within the handle 12, and is led out from the handle 12 through a guide hole 39 opened in the lower end of the handle 12 (see FIG. 1). Further, the lower end of the liquid-supply pipe 21 led out from the handle 12 is inserted into the head body 19 through the pipe-insertion sleeve 26 provided on the top surface of the head body 19 and is attached in a liquid-tight state to the pipe-attaching portion 24 of the gradual-liquid-release mechanism 16 using various known attachment jigs.

The liquid-supply pipe 21 also has an open/close valve (not shown) disposed inside the handle 12 for supplying, or stopping the supply of, the liquid agent from the tank 13 to the liquid reservoir 14 of the gradual-liquid-release mechanism 16. The open/close valve can easily be opened and closed through, for example, operation of an open/close lever 40 provided on the outer side of the handle 12 (see FIG. 1). Operating the open/close valve to open and close allows easy switching between a state e.g. upon use of the cleaning tool 10 wherein the tank 13 and the liquid reservoir 14 are in communication and the liquid agent is made suppliable with the hydrostatic pressure being exerted on the liquid reservoir 14, and a state e.g. during non-use of the cleaning tool 10 wherein the communication between the tank 13 and the liquid reservoir 14 is cut off so that no hydrostatic pressure is exerted on the liquid reservoir 14 and no liquid agent is supplied.

When carrying out cleaning and/or finishing with the cleaning tool 10 of the present embodiment having the above-described structure, a cleaning sheet is attached to the cleaning head 11 so as to cover the bottom surface 17*a* of the cleaning cushion 17, and the open/close valve is opened to exert hydrostatic pressure on the liquid reservoir 14 of the gradual-liquid-release mechanism 16 and make the liquid agent constantly suppliable from the tank 13 to the liquid reservoir 14. In this way, the liquid agent is gradually supplied substantially evenly from the whole gradual-liquid-release portion 15 of the gradual-liquid-release mechanism 16 to the cleaning sheet, and thus, it becomes possible to maintain the cleaning sheet in a suitably moistened state and to efficiently perform the cleaning and/or finishing work in a stable state while applying the liquid agent substantially evenly to a surface to be cleaned such as a floor.

On the other hand, in cases where, for example, cleaning is resumed after once halting supplying the liquid agent from the tank 13 to the gradual-liquid-release mechanism 16 to temporarily quit the cleaning, or where cleaning is carried out for a long period of time, the gradual-liquid-release portion 15 made of a porous material may get clogged either in whole or in part and/or air may build up in the liquid reservoir 14 due to, for example, drying of the liquid agent, adhesion of dust, or some other reason. This may cause difficulty for the cleaning tool 10 of the present embodiment to apply the liquid agent substantially evenly. Further, depending on the type of cleaning, it may be desirable to temporarily release a large amount of liquid agent from the gradual-liquid-release mechanism 16. In this regard, the cleaning tool 10 of the present embodiment has a hollow elastic element 22 as a pressurizing means for exerting pressure on the hydrostatic surface of the liquid agent contained in the tank 13, and this allows the cleaning tool to be easily restored to a state where the liquid agent is gradually released substantially evenly throughout the whole gradual-liquid-release mechanism 16 even when the gradual-liquid-release portion 15 gets clogged and/or air builds up in the liquid reservoir 14. Further, it becomes possible to temporarily release a large amount of liquid agent from the gradual-liquid-release portion as necessary.

That is, with the present embodiment, even in cases where, for example, the gradual-liquid-release portion 15 made of porous material gets clogged or air builds up in the liquid reservoir 14 and it becomes impossible to apply the liquid agent substantially evenly, simply pressing the bulb portion 36 of the hollow elastic element 22 to compress and deform the bulb portion will exert a considerable amount of pressure on the hydrostatic surface of the liquid agent contained in the tank 13. The pressure exerted on the hydrostatic surface, in turn, will be transferred to the liquid reservoir 14, which increases the liquid pressure of the liquid agent passing through the gradual-liquid-release portion 15 made of porous material. This increased liquid pressure allows the clogging of the gradual-liquid-release portion 15 and/or the build-up of air in the liquid reservoir 14 to be easily eliminated. Further, when a large amount of liquid agent is to be temporarily released, pressing the bulb portion 36 of the hollow elastic element 22 to compress and deform the bulb portion will increase the liquid pressure of the liquid agent passing through the gradual-liquid-release portion 15 made of porous material, and this increased liquid pressure will allow a large amount of liquid agent to be discharged from the gradual-liquid-release portion 15.

Further, according to the cleaning tool 10 of the present embodiment, the gradual-liquid-release portion 15 is provided continuously across substantially the entire width of the cleaning head 11 as viewed along the short-side (transverse) direction X (see FIG. 3) of the substantially-rectangular planar cleaning head 11 (i.e., in the direction of the arrow X' in the figure), with the gradual-liquid-release portion 15 facing the bottom surface 17*a*, which serves as the cleaning face of the cleaning head 11. Therefore, by moving the cleaning head 11 along the transverse direction X thereof, which matches the direction in which the cleaning head 11 is primarily moved upon cleaning, the liquid agent will be supplied from the lower end surface 15*c* of the gradual-liquid-release portion 15 to the cleaning sheet substantially evenly, without any uneven distribution, across substantially the entire width in the length direction Y of the cleaning head 11, with a substantially-even hydrostatic pressure being exerted, through the liquid reservoir 14, from above and across the entire top portion 15*a* of the gradual-liquid-release portion 15. Accordingly, it becomes possible to easily apply the liquid agent to the surface to be cleaned substantially evenly and thus effectively contribute to an increase in cleaning efficiency and improvement in finish upon cleaning.

Further, making the gradual-liquid-release portion 15 detachable from the cleaning head 11 allows the gradual-liquid-release portion 15 to be replaced or cleaned easily when soiled. Moreover, providing the gradual-liquid-release portion 15 continuously allows easy attachment/detachment of the portion 15.

Note that the present invention is not limited to the foregoing embodiments, and can be modified in various ways. For example, the gradual-liquid-release mechanism including the liquid reservoir and the gradual-liquid-release portion does not necessarily have to be a cartridge-type component detachably and replaceably mounted to the cleaning head, but can integrally be incorporated into the cleaning head. Alternatively, only the gradual-liquid-release portion may be made detachable-and-replaceable. The pressurizing means for exerting pressure on a hydrostatic surface of the liquid agent contained in the tank does not necessarily have to be a compressible-and-deformable hollow elastic element, but may be, for example, a piston member provided slidably along the inner circumferential surface of the tank. Further, the tank does not necessarily have to be mounted as a portion of a grip of the handle, but may be, for example, provided on the side of the handle as a separate component.

Further, other than hydrostatic pressure, the liquid agent may receive pressure either directly or indirectly from pressurizing means such as a pump to be supplied to the gradual-liquid-release portion. The cleaning tool may be of the type where no handle is connected to the cleaning head and instead the cleaning head is directly grasped during cleaning. The bottom surface of the cleaning head does not necessarily have to be substantially rectangular in shape, but may have any other shape suited for cleaning, such as an oval shape. The gradual-liquid-release portion does not have to be arranged facing the bottom surface of the cleaning head serving as the cleaning face, but may be arranged, for example, on the side portion of the cleaning head to supply the liquid agent to a cleaning sheet wrapped around the cleaning head from the side portion.

Figure 8:
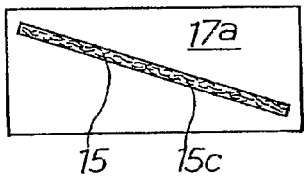
FIG. 8(*a*) is a schematic bottom view illustrating another embodiment for providing a gradual-liquid-release portion across substantially the entire width of a cleaning head.
Figure 8:
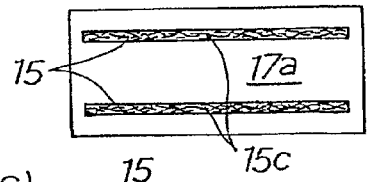
Figure 8:
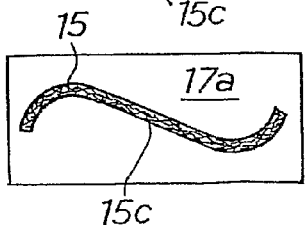
Figure 8:
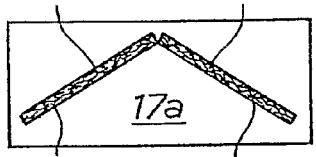
Figure 8:
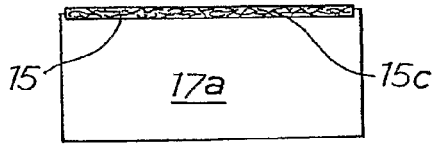
Figure 8:
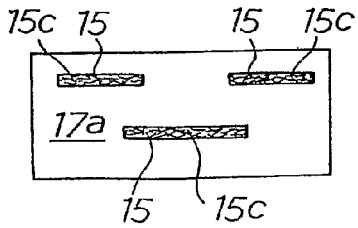

Arrangements for providing the gradual-liquid-release portion, which is provided facing the bottom surface of the cleaning head, across substantially the entire width of the cleaning head as viewed along at least one direction may take a variety of forms such as those illustrated in FIGS. 8(*a*) to 8(*f*). Among these, FIGS. 8(*a*), 8(*c*), 8(*d*), and 8(*e*) show examples of gradual-liquid-release portions provided continuously in a band-like shape.

Furthermore, the cleaning tool of the present invention is not necessarily used with a cleaning sheet attached to the cleaning head, but can be used, for example, by pressing the cleaning face of the cleaning head directly to the surface to be cleaned.

The cleaning tool of the present invention facilitates substantially-even application of a liquid agent to a surface to be cleaned and can thus contribute to an increase in cleaning efficiency and improvement in finish upon cleaning.

Further, the handle connected to the cleaning head has a tank that is in communication with the liquid reservoir via a liquid-supply pipe, and the tank has pressurizing means for exerting pressure on a hydrostatic surface of the liquid agent contained in the tank. Accordingly, the present cleaning tool can easily be restored to a state where the liquid agent is gradually released substantially evenly throughout the whole gradual-liquid-release portion even when the liquid-agent release by the gradual-liquid-release portion becomes uneven (unequal or unevenly distributed), and can also temporarily release a large amount of liquid agent from the gradual-liquid-release portion as necessary.

The invention claimed is:

1. A cleaning tool comprising:

a cleaning head, the cleaning head having a gradual-liquid-release mechanism including:

a liquid reservoir that includes an opening, and a gradual-liquid-release portion that is provided in the opening of the liquid reservoir, and that, by the action of pressure, gradually releases a liquid agent supplied to the liquid reservoir while causing the liquid agent to pass through a multitude of fine flow paths, the gradual-liquid-release portion being provided across substantially an entire width of the cleaning head as viewed along at least one direction, wherein the liquid reservoir has substantially the same length and width as the gradual-liquid-release portion, and is provided continuously across substantially the entire width of the cleaning head; and a handle that is connected to a head body of the cleaning head, the head body including:

a fitting recess to detachably hold the gradual-liquid-release mechanism, and a fluid port to detachably engage with a fluid port of the liquid reservoir when the gradual-liquid-release mechanism is held in the fitting recess.

2. The cleaning tool according to claim 1, wherein a cleaning sheet is attached to the cleaning head upon use.

3. The cleaning tool according to claim 1, wherein the gradual-liquid-release portion is provided in a band-like shape on the cleaning head.

4. The cleaning tool according to claim 3, wherein the gradual-liquid-release portion is provided continuously.

5. The cleaning tool according to claim 1, wherein:

a cleaning face of the cleaning head has a substantially rectangular shape; and the gradual-liquid-release portion is provided extending parallel to or substantially parallel to a long side of the cleaning face.

6. The cleaning tool according to claim 1, wherein:

a handle is connected to the cleaning head;

the handle has a tank that is in communication with the liquid reservoir via a liquid-supply pipe; and the tank has pressurizing means for exerting pressure on a hydrostatic surface of the liquid agent contained in the tank.

7. The cleaning tool according to claim 1, wherein:

the cleaning head includes a cleaning cushion that extends from the head body in a direction away from the handle, the cleaning cushion includes a slit to receive the gradual-liquid-release mechanism, and when the gradual-liquid-release mechanism is held in the fitting recess, the gradual-liquid-release portion extends beyond a bottom surface of cleaning cushion by a projection height of over 0 mm to under 2 mm.

8. The cleaning tool according to claim 1, wherein the liquid reservoir includes an engagement rib provided along at least a portion of a perimeter the opening of the liquid reservoir to secure the gradual-liquid-release portion to the opening of the liquid reservoir.

9. The cleaning tool according to claim 1, wherein the liquid reservoir has a fluid capacity of around 0.5 to 2 cubic centimeters.

10. A cleaning tool comprising:

a cleaning head, the cleaning head having a gradual-liquid-release mechanism including:

a liquid reservoir that includes an opening, and a gradual liquid-release portion that is provided in the opening of the liquid reservoir, and that, by the action of pressure, gradually releases a liquid agent supplied to the liquid reservoir while causing the liquid agent to pass through a multitude of fine flow paths, the gradual-liquid-release portion being provided across substantially an entire width of the cleaning head as viewed along at least one direction, wherein:

the liquid reservoir has substantially the same length and width as the gradual-liquid-release portion, and is provided continuously across substantially the entire width of the cleaning head;

a handle is connected to the cleaning head;

the handle has a tank that is in communication with the liquid reservoir via a liquid-supply pipe;

the tank has pressurizing means for exerting pressure on a hydrostatic surface of the liquid agent contained in the tank;

the pressurizing means has a hollow interior that is in communication with the tank, and includes a hollow elastic element; and the pressurizing means exerts pressure on the hydrostatic surface of the liquid agent by compressing and deforming the hollow elastic element.

11. A cleaning tool comprising:

a cleaning head, the cleaning head having a gradual-liquid-release mechanism including:

a liquid reservoir that includes an opening, and a gradual-liquid-release portion that is provided in the opening of the liquid reservoir, and that, by the action of pressure, gradually releases a liquid agent supplied to the liquid reservoir while causing the liquid agent to pass through a multitude of fine flow paths, the gradual-liquid-release portion being provided across substantially an entire width of the cleaning head as viewed along at least one direction, wherein:

the liquid reservoir has substantially the same length and width as the gradual-liquid-release portion, and is provided continuously across substantially the entire width of the cleaning head;

a handle is connected to the cleaning head;

the handle has a tank that is in communication with the liquid reservoir via a liquid-supply pipe;

the tank has pressurizing means for exerting pressure on a hydrostatic surface of the liquid agent contained in the tank; and an open/close lever is attached to the liquid-supply pipe to control communication between the tank and the liquid reservoir.

12. A cleaning tool comprising:

a cleaning head, the cleaning head having a gradual-liquid-release mechanism including:

a liquid reservoir that includes an opening, and a gradual-liquid-release portion that is provided in the opening of the liquid reservoir, and that, by the action of pressure, gradually releases a liquid agent supplied to the liquid reservoir while causing the liquid agent to pass through a multitude of fine flow paths, the gradual-liquid-release portion being provided across substantially an entire width of the cleaning head as viewed along at least one direction, wherein:

the liquid reservoir has substantially the same length and width as the gradual-liquid-release portion, and is provided continuously across substantially the entire width of the cleaning head, the liquid reservoir includes an engagement rib provided along at least a portion of a perimeter the opening of the liquid reservoir to secure the gradual-liquid-release portion to the opening of the liquid reservoir, the liquid reservoir includes a support rib, and the gradual-liquid-release portion includes a top portion that includes:

a top surface, which is in direct contact with both a space formed by the liquid reservoir and the support rib; and a bottom surface, which is in direct contact with the engagement rib, such that the gradual-liquid-release portion is held between the support rib and the engagement rib.

13. The cleaning tool according to claim 12, wherein:

the gradual-liquid-release portion includes a bottom portion that extends away from the liquid reservoir, through the opening of the liquid reservoir and past the engagement rib, and in cross-section, with the top portion provided above the bottom portion, the bottom portion is narrower in width than the top portion.

14. A cleaning tool comprising:

a cleaning head, the cleaning head having a gradual-liquid-release mechanism including:

a liquid reservoir that includes an opening, and a gradual-liquid-release portion that is provided in the opening of the liquid reservoir, and that, by the action of pressure, gradually releases a liquid agent supplied to the liquid reservoir while causing the liquid agent to pass through a multitude of fine flow paths, the gradual-liquid-release portion being provided across substantially an entire width of the cleaning head as viewed along at least one direction, wherein the liquid reservoir has substantially the same length and width as the gradual-liquid-release portion, and is provided continuously across substantially the entire width of the cleaning head, and the liquid reservoir has a U-shaped cross-section that includes opposing engagement ribs provided at ends of the U-shaped cross-section along at least portions of a perimeter of the opening of the liquid reservoir to secure the gradual-liquid-release portion to the liquid reservoir.

15. The cleaning tool according to claim 14, wherein:

the liquid reservoir includes a support rib;

the gradual-liquid-release portion includes a top portion, which is confined within the liquid reservoir, and a bottom portion, which extends out of the opening of the liquid reservoir between the opposing engagement ribs;

the top portion includes:

a top surface, which is in direct contact with both a space formed by the liquid reservoir and the support rib, and bottom surfaces, which are separated by the bottom portion, and which are in direct contact, respectively, with the engagement ribs; and the gradual-liquid-release portion is held between the support rib and the engagement ribs.

16. The cleaning tool according to claim 15, wherein, in cross-section, with the top portion provided above the bottom portion, the bottom portion is narrower in width than the top portion.

17. The cleaning tool according to claim 15, wherein, in cross-section, with the top portion provided above the bottom portion, the gradual-liquid-release portion has a T-shape.

18. The cleaning tool according to claim 15, wherein:

the liquid reservoir includes a plurality of support ribs that are separated from each other in the width direction of the cleaning head, and spaces are provided between each of the support ribs and one or more walls of the U-shaped cross-section of the liquid reservoir.

* * * * *